United States Patent [19]

Reiss

[11] Patent Number: 4,821,645

[45] Date of Patent: Apr. 18, 1989

[54] MULTI-DIRECTIONAL SIGNAL TRANSMISSION IN A BLAST INITIATION SYSTEM

[75] Inventor: Peter F. Reiss, Sugarloaf, Pa.

[73] Assignee: Atlas Powder Company, Dallas, Tex.

[21] Appl. No.: 72,544

[22] Filed: Jul. 13, 1987

[51] Int. Cl.[4] ..... F42B 3/10; C06C 5/00

[52] U.S. Cl. ..... 102/275.7; 102/275.3; 102/275.12

[58] Field of Search ..... 102/275.3, 275.4, 275.5, 102/275.7, 275.9, 275.11, 275.12, 317, 318, 320, 322, 313, 331

[56] References Cited

U.S. PATENT DOCUMENTS

| | | | |
|---|---|---|---|
| 1,887,122 | 11/1932 | Duffy | 102/275.7 |
| 2,475,875 | 7/1949 | Burrows et al. | 102/312 |
| 2,887,053 | 5/1959 | Itria et al. | 102/317 |
| 2,952,206 | 9/1960 | Beckstead | 102/275.7 |
| 3,175,491 | 3/1965 | Robertson | 102/275.7 |
| 3,207,073 | 9/1965 | Miller | 102/275.1 |
| 3,246,602 | 4/1966 | Meredith et al. | 102/317 |
| 3,349,706 | 10/1967 | Schaumann | 102/275.7 |
| 3,353,485 | 11/1967 | Miller et al. | 102/275.3 |
| 3,358,601 | 12/1967 | Dittmann et al. | 102/318 |
| 3,395,642 | 8/1968 | Foster et al. | 102/317 |
| 3,570,402 | 3/1971 | Anderson et al. | 102/275.12 |
| 3,709,149 | 1/1973 | Driscoll | 102/312 |
| 3,713,384 | 1/1973 | Turnbull | 102/275.5 |
| 3,727,552 | 4/1973 | Zakheim | 102/275.3 |
| 3,776,135 | 12/1973 | Zebree | 102/275.9 |
| 3,878,785 | 4/1975 | Lundbord | 102/275.4 |
| 3,885,499 | 5/1975 | Hurley | 102/275.9 |
| 3,939,772 | 2/1976 | Zebree | 102/275.9 |
| 3,987,732 | 10/1976 | Spraggs et al. | 102/275.5 |
| 3,987,733 | 10/1976 | Spraggs et al. | 102/275.4 |
| 4,187,780 | 2/1980 | Petruccelli | 102/275.12 |
| 4,299,167 | 11/1981 | Bryan | 102/202.3 |
| 4,335,652 | 6/1982 | Bryan | 102/202.1 |
| 4,350,097 | 9/1982 | Bowman et al. | 102/275.2 |
| 4,424,747 | 1/1984 | Yunan | 102/275.2 |
| 4,426,933 | 1/1984 | Yunan | 102/275.3 |
| 4,438,699 | 3/1984 | Nitzberg | 102/313 |
| 4,442,776 | 4/1984 | Jones | 102/275.12 |
| 4,481,884 | 11/1984 | Yunan | 102/313 |
| 4,527,482 | 7/1985 | Hynes | 102/331 |
| 4,632,034 | 12/1986 | Colle | 102/275.11 |
| 4,730,560 | 3/1988 | Bartholomew et al. | 102/275.3 |

*Primary Examiner*—David H. Brown

*Attorney, Agent, or Firm*—Richards, Harris, Medlock & Andrews

[57] ABSTRACT

The invention provides a connector, a transmitter, a bi-directional device, and a method for increasing the reliability of borehole detonation by using the connectors and transmitters provided by the invention. The invention provides connectors, each connector having a well for receiving a blasting cap, one or more ports or channels for receiving a transmission line and/or downline, and means for joining one connector with another connector in a convenient manner. The connectors are constructed so that detonation of a blasting cap in one connector will cause sympathetic detonation of a blasting cap in an adjoining connector. The detonation of blasting caps in the connectors also causes initiation of transmission lines and/or downlines which are inserted in the ports or channels through the connectors. A transmitter is comprised of one or more of these connectors with the transmission lines being arranged so that the transmitter receives a signal from one line and outputs it to at least one other transmission line or downline. A bi-directional device is provided that consists of a transmission line with blasting caps attached to each end and the caps are inserted into the wells of connectors as described below. The method of the present invention includes the use of the transmitters and arranging them such that there are at least two signal paths from which a transmitter may receive an initiation signal.

17 Claims, 4 Drawing Sheets

FIG. 1
(PRIOR ART)
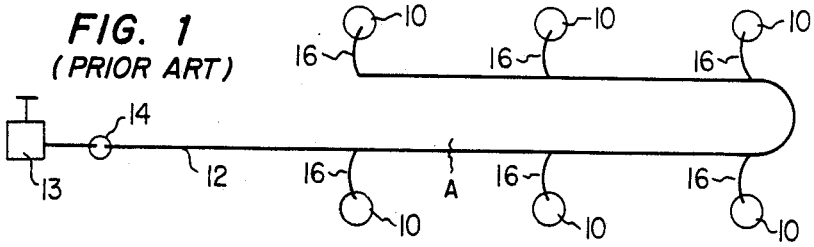
FIG. 2
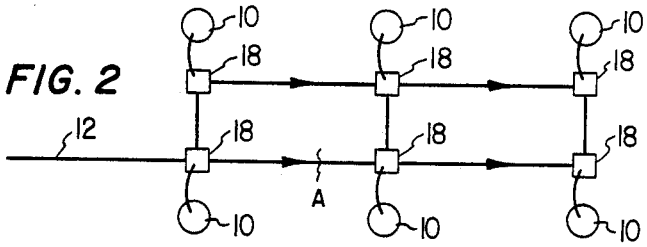
FIG. 3
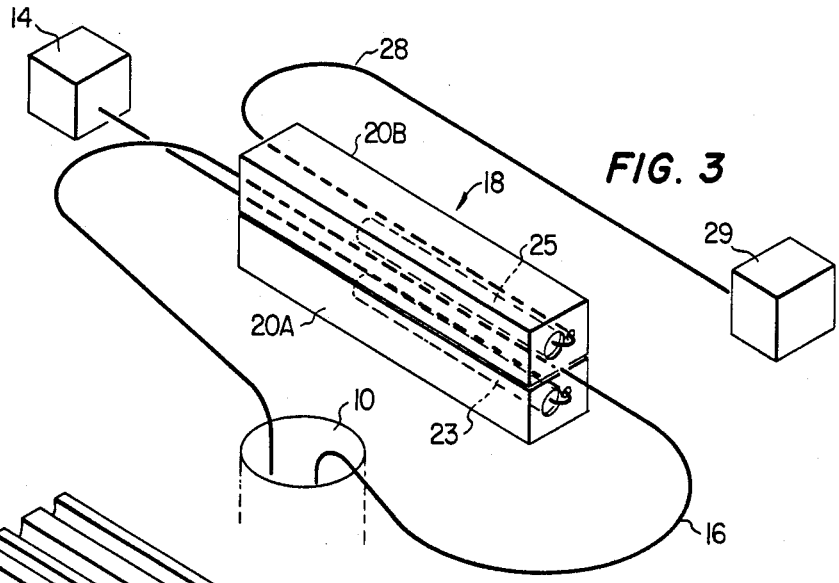
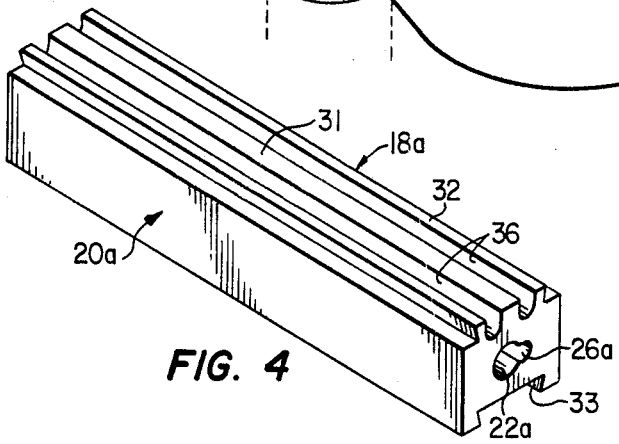
FIG. 4

FIG. 6
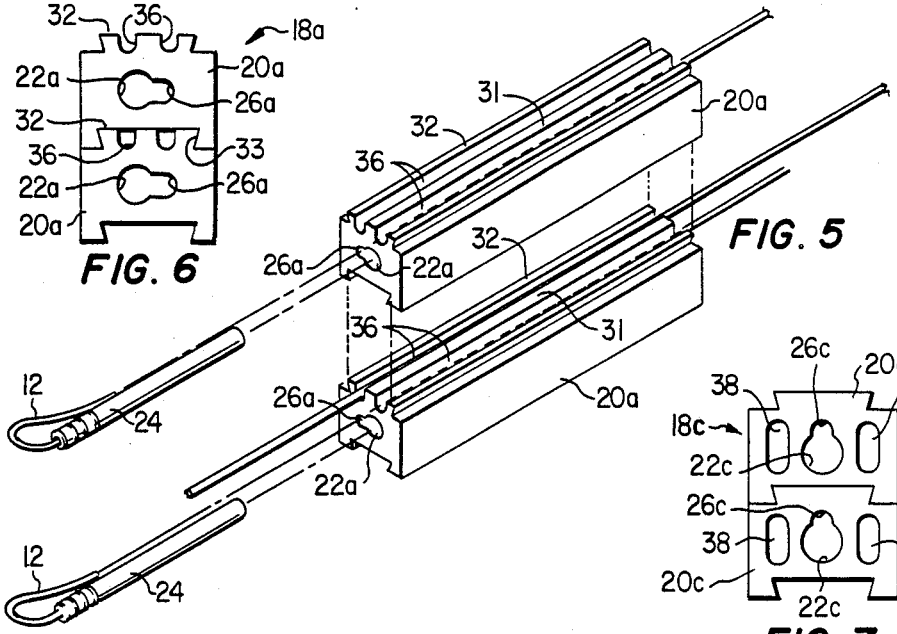
FIG. 5
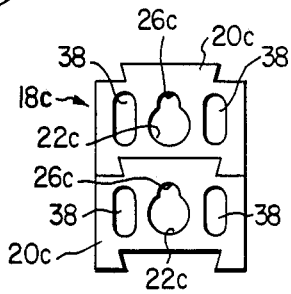
FIG. 7
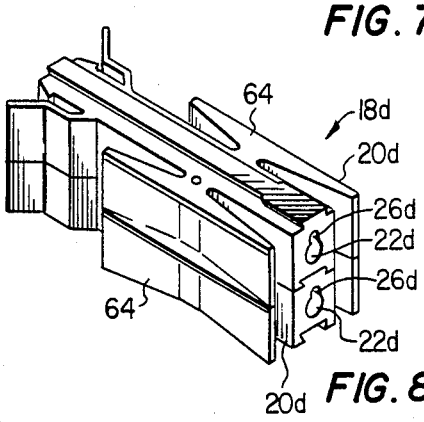
FIG. 8
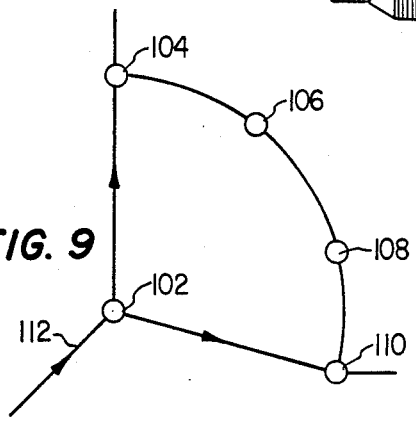
FIG. 9
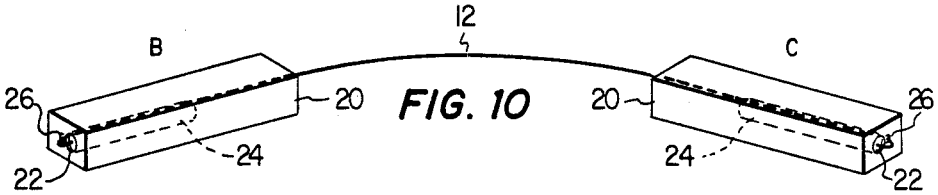
FIG. 10

MULTI-DIRECTIONAL SIGNAL TRANSMISSION IN A BLAST INITIATION SYSTEM

TECHNICAL FIELD

A method and an apparatus for transmitting a detonation signal in a bi-directional and multi-directional manner to increase reliability of detonating explosives in a borehole.

BACKGROUND OF THE INVENTION

In blasting operations, various devices are used to transmit a blast signal from a remote initiation location to explosives in a borehole. These devices include transmission lines, delays, downlines, and detonators that are arranged in such a manner as to detonate explosives in a desired sequence and pattern. In nonelectric systems, delay elements are interposed along the transmission lines and in the boreholes to establish a blast pattern. The transmission lines carry the blast signal from an initiator to downlines or to surface delay devices. Downlines transmit the signal from transmission lines or surface delay elements to the explosives in the boreholes. The downlines may be attached to delay devices in the borehole and/or to instantaneous blasting caps in the borehole. The explosives within a borehole may also be decked, i.e., loaded in explosive sections that detonate at different times. The use of delay devices to detonate the boreholes in a predesigned pattern also helps to reduce noise and vibration incident to blasting operations which is important in light of governmental regulations and complaints from nearby residents. Due to these advantages, the industry has made wider use of delay devices.

A disadvantage in using delays has been the increased potential for malfunctions in the blast caused by the breaking of transmission lines and downlines prior to being activated. Such breaks may be caused by a line being severed by shifting or falling rock that is set in motion by the first portion of the blasting sequence. Malfunctions may also be due to defective transmission lines or delay devices. As a result of these malfunctions, one or more boreholes may fail to detonate because they do not receive a firing signal. The industry requires reliable detonation because of the hazards involved when a charge of explosives is not detonated.

The usual means of assuring total detonation of a pattern of explosives is to provide a redundant backup circuit. In the past, this was difficult and very costly to do and still achieve the desired delays of the pattern. The present invention provides a simple and economical means of providing a backup signal to insure reliable detonation and a system that maintains the desired sequence in a blasting pattern. The invention includes an apparatus that is easy to construct and simple to use.

SUMMARY OF THE INVENTION

The invention provides a method for multi-directional signal transmission within a blast pattern such that back-up signals can be sent to each borehole in the pattern to ensure reliable detonation without having a completely redundant back-up circuit.

The invention also provides a connector and a transmitter which may be utilized to achieve the method described by the invention as these devices can accommodate multiple inputs and outputs. A connector is a single block device having a well for insertion of a blasting cap, one or more channels or passages through the connector for the insertion of a downline and/or a signal transmission line, and means for firmly joining other connectors in a side-by-side alignment. The connectors are constructed and joined in such a manner that the detonation of a blasting cap positioned within the well of one connector will detonate a blasting cap positioned within the well of an adjoining connector. The connectors are also constructed such that the detonation of a blasting cap within the well will initiate the downline(s) and/or signal transmission line(s) positioned within the channel(s) provided.

According to one embodiment of the invention, a bi-directional device is provided in which a blasting cap is connected to each end of a signal transmission line, and each blasting cap is inserted into the well of a connector. The transmission line is inserted through a channel in the connector such that the transmission line is initiated by the detonation of the blasting cap. The device may be used to provide a signal transmission in either direction along the line.

A transmitter as provided by the present invention includes one or more connectors stacked or joined together in numbers up to ten or more. These transmitters may be placed along signal transmission lines at branch points to provide multiple input for receiving the signal and output lines for outputting the signal either to downlines or signal transmission lines. The transmitters are capable of receiving initiation from any transmission line coming into the transmitter and outputting that signal to a multiplicity of output lines. The use of the transmitters allows for bi-directional signal transmission within a blast pattern. To achieve reliable detonation of the blast pattern, each transmitter is connected to at least two other transmitters in the pattern, or has two transmission lines from which it could receive a signal. In order to maintain a desired blast sequence using surface delays, each transmitter in a series of transmitters to be initiated at the same time may be connected to at least one other transmitter in the series by a delay-free transmission line. Thus, a multiplicity of signal paths can be arranged to maintain the desired delays and ensure reliable detonation of the entire blast pattern.

BRIEF DESCRIPTION OF THE DRAWINGS

A more complete understanding of the invention may be had by reference to the following Detailed Description when taken in conjunction with the accompanying Drawings wherein like reference characters denote like parts in all views and wherein:

FIG. 1 illustrates a series of boreholes connected by a transmission line with downlines to each borehole as a representation of the arrangement in the prior art;

FIG. 2 illustrates a blasting arrangement utilizing the transmitters of the present invention for the configuration as shown in FIG. 1;

FIG. 3 shows a transmitter containing two connectors joined together with an input line from the initiator, an output line to the next transmitter, and down-lines to a borehole;

FIG. 4 is a perspective view of one embodiment of the connectors of the present invention illustrating the tube ports and a dovetail joint;

FIG. 5 is an exploded view of one embodiment of a connector showing the connection means, blasting cap wells, and the various tube channels;

FIG. 6 is an end view of one embodiment showing two connectors joined together;

FIG. 7 shows an end view of another embodiment of two connectors joined together;

FIG. 8 shows yet a third embodiment for the connectors, a perspective view of the connectors with wing-like extensions from the sides;

FIG. 9 illustrates a bi-directional blasting pattern;

FIG. 10 shows a bi-directional device with a connector attached to each end of a transmission line;

DETAILED DESCRIPTION

Figure 11:
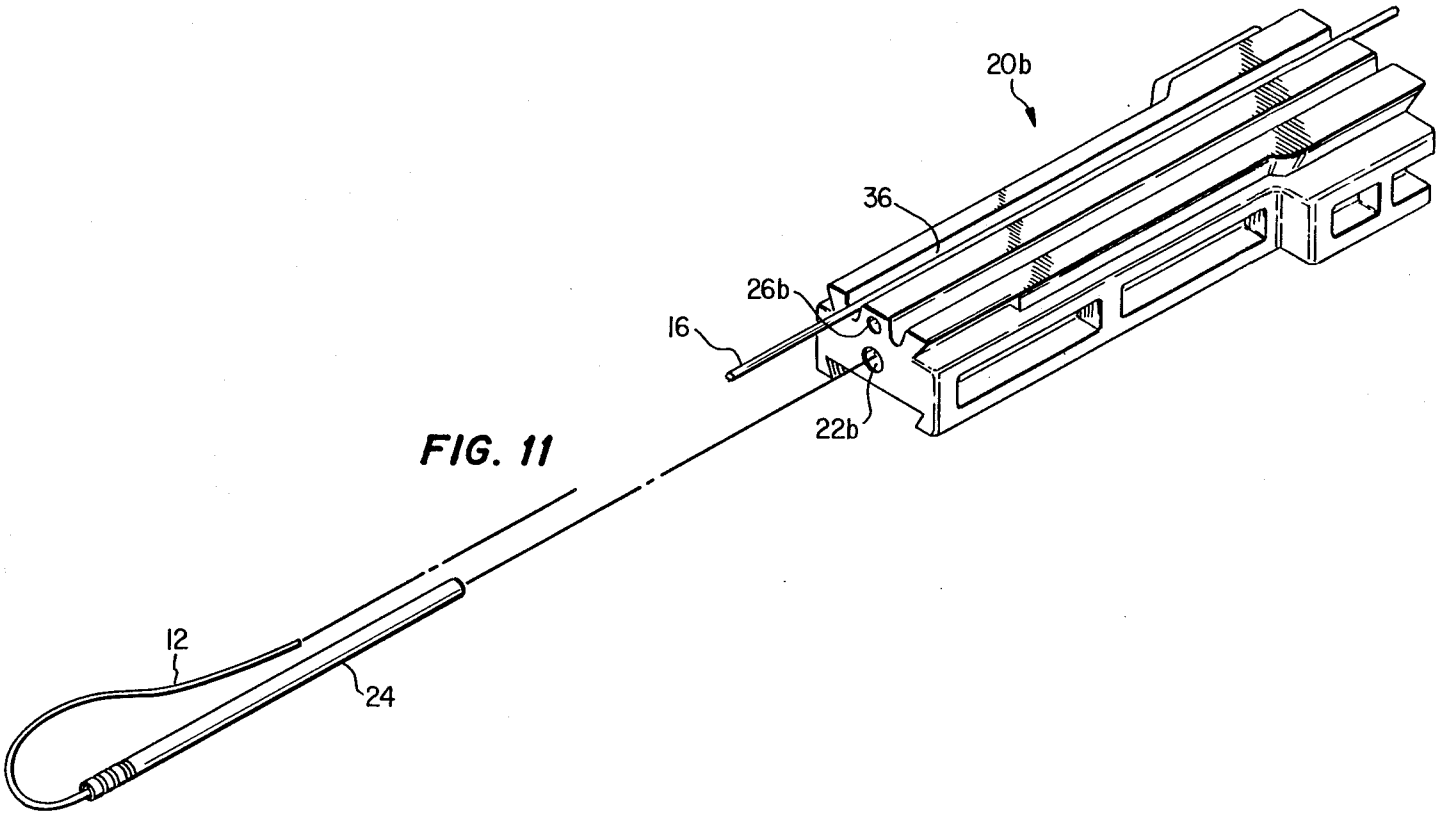
FIG. 11 shows yet another embodiment of a connector with the tube channels arranged in the joint section of the connector.

The present invention provides a signal transmission method that ensures reliable detonation of an entire blast pattern by sending an initiation signal in multiple directions around the pattern. Using this method, a blasting pattern can be arranged such that a proper blasting sequence, including delays, is maintained. The invention also provides a connector and a transmitter that may be used in the method to achieve multi-directional signal transmission within a blast pattern.

Most nonelectric initiation systems in the prior art are arranged as shown in FIG. 1 in that the signal is only sent in one direction. FIG. 1 shows a series of boreholes 10 connected by a signal transmission line 12. A blaster 13 starts the transmission by initiating the initiator cap 14. As a result, the initiator cap 14 transmits a signal through line 12, down separate downlines 16 into each borehole. If the transmission line 12 was broken at any point, for example point A in FIG. 1, the result would be that only the borehole(s) prior to the break would be initiated and explode. The remaining boreholes would not detonate. If there was a malfunction in one of the surface delays or the transmission line was severed, the circuit would be broken and the signal not passed on to the next borehole in the pattern. The result would be that boreholes down the line would not explode thereby leaving a costly and dangerous condition.

The method of the present invention provides a means to ensure reliable detonation even if there is a break in the transmission line. This is accomplished by the use of connectors and transmitters as described by the present invention. As illustrated in FIG. 2, transmitters 18 allow for bi-directional signal transmission. Thus, if the transmission line 12 is severed at point A or the signal is interrupted for another reason, a signal will still reach all the boreholes due to the bi-direction transmission of the signal in both directions around the loop pattern. A more complicated pattern may be set up that utilizes multi-directional signal transmission.

This multi-directional signal transmission is achievable due to the nature of the transmission line 12 and the connectors and transmitters of the present invention. The transmission line 12 is a reactive signal tube such as those illustrated in U.S. Pat. No. 4,290,366 to Janowski, the disclosure of which is hereby incorporated by reference. The hollow tube contains a reactive material such that a detonation signal is transmitted along the tube by oxidation and the creation of a plasma front. A similar transmission tube is also disclosed in U.S. Pat. No. 3,590,739, the disclosure of which is hereby also incorporated by reference. Importantly, these tubes can transmit a signal in either direction along the tube depending on which end is initiated first.

As an alternative transmission line 12, low strength detonating cord may be used. It is important, however, that the cord not be of such strength as to detonate a blasting cap by laying alongside the cap as this would bypass any delay that is incorporated into the cap.

Figure 12:
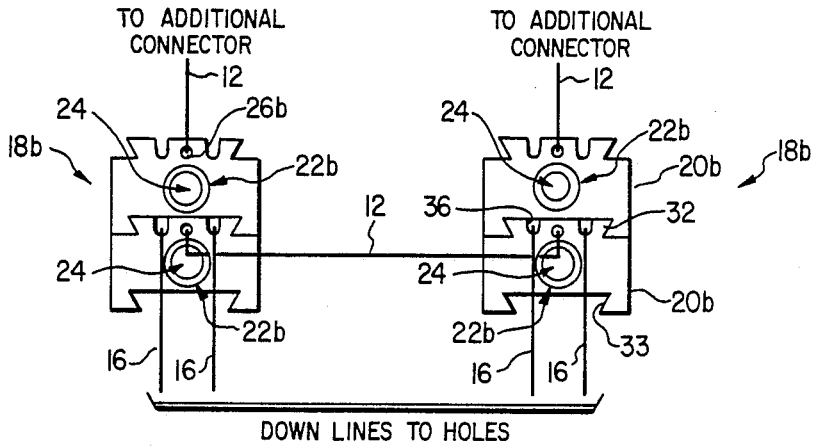
FIGS. 12 and 13 illustrate possible arrangements of the signal transmission lines in and out of two transmitters each formed using two of the connectors shown in FIG. 11.
Figure 13:
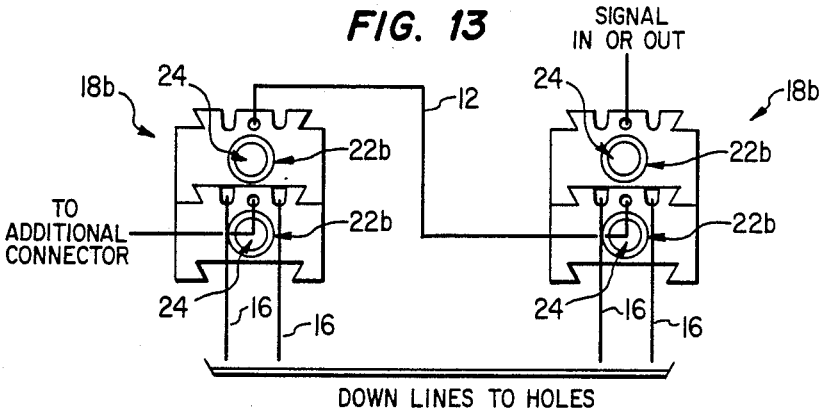

An embodiment of a connector as provided by the present invention is shown in FIG. 4. An alternative embodiment is shown in FIG. 11. As shown in FIG. 4, the connector 20*a* has a well 22*a* for receiving a blasting cap so that the cap fits rather snugly into the well. Connector 20*a*, 20*c*, 20*d* has at least one channel 26*a*, 26*c*, 26*d* to allow insertion of a transmission line 12. Channel 26*a*, 26*c*, 26*d* extends for the length of the connector 20*a*, 20*c*, 20*d* and is such that the transmission line 12 may lie alongside the blasting, cap 24 as shown in FIG. 5 or lies in a hole 26*b* slightly separated from the blasting cap well 22*b* as in the connectors shown in FIGS. 11, 12 and 13. The connector 20*a* and 20*b* may also provide one or more downline channel(s) or port(s) 36 to accommodate insertion of one or, more downline(s) 16. The connector 20*a*, 20*b*, 20*c*, 20*d* also includes a means for securing one connector to another connector in close proximity. As shown in FIGS. 4 and 11, this may be done using a dovetail joint with joint means 32 fitting into a slot 33 on a second similar connector. The downline channels 36 formed in the joint 32 are enclosed as two connectors are joined as shown in FIGS. 12 and 13. Other means for securing the connectors in close proximity such as fasteners, hooks, clamps, joints, etc. may be used in place of the dovetail joint described above.

The downlines 16 are preferably detonating cord but other signal transmission tubes may be used as downlines. The downlines 16 must be such that they can be initiated by the detonation of the blasting cap in the well. The design and materials of the connector must accommodate this initiation.

The connectors 20*a*, 20*b*, 20*c*, 20*d* must be constructed of such material and proportioned so that detonation of the blasting cap 24 causes initiation of the downline(s) 16 and/or signal transmission line(s) 12 and cause sympathetic detonation of blasting caps in attached connectors. The connectors 20*a*, 20*b*, 20*c*, 20*d* are preferably constructed of high density plastic, most preferably with a density greater than about 0.95 g/cm$^3$. It has been found through laboratory testing that there should be no more than $\frac{1}{4}$ inch of material between the well 22*a*, 22*b*, 22*c*, 22*d* and the downline, port 38 or the transmission line channel 26*a*, 26*b*, 26*c*, 26*d*. A greater amount may be between the wells 22*a*, 22*c*, 22*d* of attached connectors, but the connectors 20*a*, 20*b*, 20*c*, 20*d* must be so constructed and joined as to ensure sympathetic detonation of blasting caps in attached connectors—i.e., the detonation of a blasting cap in one connector will initiate detonation of the cap in an adjoining connector.

The blasting caps 24 are attached to the end of the transmission line 12 such than an incoming signal from the line 12 will detonate the blasting cap. The blasting caps 24 may be instantaneous caps, meaning that as soon as an input signal is received the cap explodes, or they may be of the delay type. A delay cap does not explode when a signal is received until after a predetermined delay period has expired. Delay periods are commonly provided in terms of milliseconds, such as 25, 50, 100, etc. In use, the blasting caps are inserted into the cap well, preferably with a snug fit such that they will not slip out. The connector provides protection from accidental discharge by impact.

FIG. 10 shows a bi-directional device included in the present invention. Two connectors 20 are positioned at each end of a transmission line 12 with a blasting cap 24 attached to each end of line 12 and the caps 24 being inserted into well 22. The connectors 20 include means for attachment to other connectors as described above. In this embodiment of the invention, it is preferable that each cap have a similar delay, if any, so that the device may be used without regard to which end has a different delay. As shown in FIG. 10, the line 12 is positioned in a channel 26 beside the blasting cap and runs along the length of the blasting cap. Again, it is important that the transmission line 12 be in close proximity with the blasting cap 24 for most of the length of the cap to ensure the initiation of the line 12 when the cap detonates in response to sympathetic detonation of a cap in an adjoining connector. Once the line 12 is initiated at one end, a plasma front reaction will propogate through the reactive material in the tube to the other end inserted in the second blasting cap thereby initiating that cap. In this manner, a bi-directional device is provided. If the cap labelled "B" in FIG. 10 is initiated first, a detonation signal will be sent to the cap "C," and vice versa. Thus, a blasting initiation signal could be sent in either direction along line 12 in FIG. 10.

In order to achieve bi-directional and even multi-directional signal transmission within a blast pattern, the present invention provides signal transmitters 18 as shown in FIGS. 3, 5, 6, 7, 8, 12 and 13, which transmitters are comprised of one or more connectors 20*a*, 20*b*, 20*c*, 20*d* that are joined together. Typically, a transmitter will include 2-4 connectors, but more than this number may be used depending on the number of output lines desired. During testing, it has been found that up to ten connectors can be stacked together to achieve reliable mass detonation of the blasting caps in all the connectors. FIG. 3 shows a simple system incorporating a transmitter 18. An initiator 14 sends a signal down transmission line 12 by initiating a reaction in line 12. The signal is carried to blasting cap 23 contained within the bottom connector 20A of transmitter 18. The signal causes cap 23 to detonate which in turn causes cap 25, contained in the attached upper connector 20B, to detonate. The detonation of caps 23 and 25 initiates a signal in downline 16 which is shown exiting both ends of the transmitter 18 and entering a borehole 10. This dual downline may be used in a decking arrangement or may serve as a backup signal to the borehole. In the alternative, one end of downline 16 may be tagged or closed off. Various configurations and arrangements for downline 16 using one or two separate downlines may also be used. The detonation of cap 25 also serves to initiate transmission line 28 which carries a signal to the next transmitter 29 located at the next borehole. Adding multiple connectors 20 to transmitter 18 would allow multiple output lines, including both downlines if desired, and transmission lines.

FIG. 3 also illustrates the bi-directional capabilities of the invention. If transmitter 18 received no signal via line 12, transmitter 18 could still receive a signal from transmitter 29 via line 28. The line 28 signal would detonate blasting cap 25 which explosion would then detonate blasting cap 23 and initiate downline 16 and transmission line 12. Thus, the invention allows the function of any input and output lines to be reversed, i.e. to be able to receive the signal from any transmission line that is attached to a blasting cap within one of the wells of a connector in the transmitter and output the signal through the rest of the lines passing through the transmitter.

A transmitter 18*a* comprised of two connectors 20*a* is shown in FIG. 5 in an exploded view to more clearly illustrate the various parts. Each connector 20*a* has a well 22*a* for receiving the blasting cap 24 and a channel 26 alongside well 22*a* to accommodate insertion of the transmission line 12. Line 12 is doubled back so as to lie adjacent cap 24 in channel 26. Downline 16 is inserted in port 36 that is formed by joining the two connectors. The connectors are joined using a dovetail joint by sliding joint means 32 on one connector into the slot 33 on the other. An additional port 31 is formed in the joint section to accommodate an additional downline 16 or signal line 12. FIG. 6 shows an end view of the transmitter shown in FIG. 5.

FIG. 7 shows an alternative configuration for a transmitter 18. The downline ports 38 are on either side of well 22*c* and channel 26*c* instead of being formed in the joint section. As mentioned, it is important that the downlines 16 be in close proximity to the blasting cap 24 to ensure that the downlines are initiated by the detonation of cap 24. The ports 38 are structured to allow for insertion of a doubled downline 16.

FIG. 8 shows, another embodiment of a transmitter 18*d* with wing-like protrusions 64 from each side of the transmitter to provide an anchor for securing excess signal tube. Such extensions may also be used to secure downlines 16 within close proximity of the blasting cap 24 so as to initiate the downlines.

FIGS. 12 and 13 illustrate possible configurations of transmission lines 12 in transmitters comprised of two connectors as shown in FIG. 11. In these configurations, the downlines 16 and one of the signal lines 12 are between the two cap wells 22. This position places the lines in close proximity to two blasting caps thereby increasing the reliability of initiation of the lines. FIGS. 12 and 13 illustrate the reversability of the transmitters of the present invention. The transmission lines 12 coming in and out of the transmitter 18*b* may be arranged in any configuration; the transmitter 18*b* is capable of receiving a signal from any of the transmission lines 12 and outputs that signal to the remaining lines 12 and the downlines 16.

The method of the present invention includes the use of these connectors and transmitters to achieve multi-directional transmission of a signal around a blasting pattern to ensure complete detonation of the entire pattern. For example, if a simple loop pattern is utilized, the signal can be sent both ways around the loop. This result is achievable due to the ability of the transmitters to receive a signal from any of the attached transmission lines and output the signal to all the remaining lines. The method comprises connecting a downline or downlines from each borehole to a transmitter comprised of one or more, preferably 2–10, connectors as described above. The connectors each contain a blasting cap within a well, and a transmission line is inserted into the cap so as to initiate detonation of the cap as a signal is received through the line. The transmitter may include one or more downlines and/or one or more transmission lines per connector. The lines are inserted into the appropriate channels or ports in each connector. The connectors are joined to form each transmitter such that sympathetic detonation of all the blasting caps within the transmitter occurs when one of the caps receives a signal and detonates. The downlines and transmission lines are initiated by the detonation of the blasting caps. A blasting pattern or sequence is established, and each transmitter in the pattern is connected via a transmission line to at least one other transmitter. To insure complete detonation of the pattern, it is preferred to have a backup signal route thereby requiring that each transmitter in the pattern be connected to at least two other transmitters.

The transmitters may be arranged and interconnected in such a manner as to maintain a desired time sequence for the blasting. FIG. 9 illustrates the configuration of transmitters and lines necessary to maintain the sequence for each portion of the blast pattern. The blast signal is inputted on line 112 to transmitter 102 and outputted to transmitters 104 and 110. A 20 millisecond delay is scheduled between the initiation of transmitter 102 and the series 104, 106, 108 and 110, with the latter series scheduled to be initiated at the same time (excepting the time that it takes for the signal to travel between transmitters 104 and 110 which is almost instantaneous). Basically, the arrangement that is required to maintain the desired blasting sequence and scheduled delays is to interconnect the transmitters in a series that are scheduled to be initiated at the same time so that there are two signal input paths into the series and no delays between elements of the series. This pattern is repeated for each series of transmitters scheduled to be initiated at the same time within the pattern.

The present invention describes devices used in achieving bi-directional and multi-directional signal transmission within a blast pattern. A method is also described for ensuring complete detonation of the pattern. As will be apparent to persons skilled in the art, various modifications, adaptations and variations of the foregoing specific disclosure may be made without departing from the teachings of the present invention.

We claim:

1. A connector comprising:

(a) a body of high density plastic defining a well for receiving a blasting cap;

(b) a channel within said body, said channel being no more than ¼ inch away from said well for a length substantially equal to the length of said well;

(c) at least one port within said body, said port being no more than ¼ inch away from said well for a length substantially equal to the length of said well; and (d) means disposed on said body for securing said connector to other connectors, such that the wells for receiving a blasting cap lay adjacent to one another.

2. The connector of claim 1 wherein a slot disposed on one side of said body dimensioned for receiving the flanged joint of another connector; and a flanged joint extending from said body disposed on the opposite side of said body from the slot.

3. A bi-directional blast signal transmission device, comprising:

a signal transmission line;

blasting caps attached to each end of the transmission line;

connectors, each having a well for receiving a blasting cap, a channel for receiving a transmission line such that the transmission line lies in close proximity to said well, and means for firming joining one connector to another connector in such a manner and in such close proximity as to enable the detonation of a blasting cap in one connector to detonate the blasting cap in the adjoining connector; and the blasting caps being inserted within the well of each connector, and the transmission line being inserted into said channel.

4. The device of claim 3 wherein the means for joining the connectors is a dovetail joint.

5. The device of claim 3 further comprising at least one tube port being formed when two connectors are joined together.

6. The device of claim 5 further comprising a downline being inserted into each port.

7. A transmitter for transmitting an input signal from an input line to one or more output lines, said transmitter comprising:

a first connector having a well for receiving a blasting cap, an input line being inserted into the blasting cap so as to initiate the cap when a signal is received from the input line, and means for firmly joining the first connector with a second connector;

a second connector having a well for receiving a blasting cap and means for firmly joining the second connector with the first connector;

said transmitter having at least one channel for receiving a transmission line or downline, said channel being no more than ¼ inch from the well in either the first or second connectors for substantially the length of the well; and said first and second connectors being joined in such a manner as to allow for sympathetic detonation of blasting caps inserted in the wells and initiation of a transmission line or downline inserted through the channel.

8. The transmitter of claim 7 wherein the means for joining the first and second connectors is a dovetail joint.

9. The transmitters of claim 7 wherein the connectors are made of plastic with a density greater than about 0.95 g/cm$^3$.

10. A transmitter useful in transmitting a blast signal comprising:

two or more connectors joined together, each said connector comprising:

(a) a body of high density plastic defining a well for receiving a blasting cap;

(b) two or more channels for receiving transmission lines formed in said connector being no more than ¼ inch from said well for a length substantially equal to the length of said well; and (c) means disposed on each said connector for firmly joining each said connector to other connectors, such that the wells for receiving blasting caps lay adjacent to one another.

11. The device of claim 10 wherein two or more of the transmission lines are downlines for carrying the signal to a borehole and where two or more of the transmission lines carry a signal away from the device.

12. The device of claim 10 wherein the transmission lines are a reactive signal tube that transmits a signal by creation and propogation of a plasma front.

13. The device of claim 10 further comprising a channel adjacent to the well for substantially the length of the well, said channel adapted for receiving a transmission line.

14. The device of claim 10 wherein the means for firmly joining the connector is a dovetail joint with each connector capable of being joined to two other connectors.

15. The device of claim 14 wherein said channels for receiving transmission lines are positioned in the joint area as the connectors are joined together.

16. The device of claim 10 wherein at least one of the signal transmission lines is a downline for carrying the signal to a borehole.

17. The device of claim 16 wherein the downlines are comprised of detonating cord.

* * * * *